US010930247B2

(12) United States Patent
Ku

(10) Patent No.: US 10,930,247 B2
(45) Date of Patent: Feb. 23, 2021

(54) ELECTRONIC APPARATUS AND METHOD OF CONTROLLING THE SAME

(71) Applicant: SAMSUNG ELECTRONICS CO., LTD., Suwon-si (KR)

(72) Inventor: Jungmin Ku, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 16/812,548

(22) Filed: Mar. 9, 2020

(65) Prior Publication Data

US 2020/0294470 A1 Sep. 17, 2020

(30) Foreign Application Priority Data

Mar. 14, 2019 (KR) ..... 10-2019-0029422

(51) Int. Cl.
*G09G 5/10* (2006.01)
*G09G 3/20* (2006.01)

(52) U.S. Cl.
CPC ..... *G09G 5/10* (2013.01); *G09G 3/2003* (2013.01); *G09G 2320/0646* (2013.01); *G09G 2320/0666* (2013.01); *G09G 2354/00* (2013.01)

(58) Field of Classification Search
CPC ..... G09G 2360/144; G09G 2320/0666; G09G 2320/0626; G09G 5/02; G09G 3/2003; G09G 2320/0242; G09G 3/3413; G09G 3/3406; G09G 2340/06; G09G 2320/0653; G09G 2320/0606; G09G 2360/145; G09G 2330/021; G09G 2320/0673; G09G 2320/0276; H04N 9/73; H04N 9/3182
USPC ..... 345/207, 589
See application file for complete search history.

(56) References Cited

U.S. PATENT DOCUMENTS 6,693,647 B1 * 2/2004 Bernard ..... G06F 3/14 715/700
7,583,318 B2 9/2009 Ok et al.
9,965,999 B1 * 5/2018 Barnes ..... G09G 3/32
2006/0061588 A1 3/2006 Ok et al.
2009/0219306 A1 * 9/2009 Oh ..... G09G 3/3225 345/690

(Continued)

FOREIGN PATENT DOCUMENTS

JP 2003131641 A * 5/2003 ..... G09G 5/02
KR 20090070702 A * 7/2009 ..... G09G 2320/0233

(Continued)

OTHER PUBLICATIONS

Communication dated Jul. 13, 2020, issued by the Korean Intellectual Property Office in corresponding Korean Application No. 10-2019-0029422.

(Continued)

*Primary Examiner* — Koosha Sharifi-Tafreshi
(74) *Attorney, Agent, or Firm* — Sughrue Mion, PLLC

(57) ABSTRACT

Disclosed are an electronic apparatus and method of controlling the same. The electronic apparatus includes a display configured to output content, a processor, and a memory where the memory is configured to store instructions set to instruct the processor to obtain an output brightness value of the display, and change a color parameter of the content output through the display based on a difference between the obtained output brightness value and a reference output brightness value of the display.

20 Claims, 8 Drawing Sheets

(56) References Cited

U.S. PATENT DOCUMENTS

| | | | | |
|---|---|---|---|---|
| 2010/0123401 | A1 | 5/2010 | Park et al. | |
| 2012/0038688 | A1* | 2/2012 | Deyama | G09G 5/02 345/690 |
| 2017/0039919 | A1* | 2/2017 | Wu | G09G 5/10 |
| 2018/0144718 | A1 | 5/2018 | Park et al. | |
| 2020/0082791 | A1* | 3/2020 | Petrie | G06F 3/013 |

FOREIGN PATENT DOCUMENTS

| | | | | | |
|---|---|---|---|---|---|
| KR | 10-2009-0093018 | A | | 9/2009 | |
| KR | 10-2018-0058363 | A | | 6/2018 | |
| KR | 20190026128 | A | * | 3/2019 | G06K 9/00 |

OTHER PUBLICATIONS

Communication dated Jun. 25, 2020, from the European Patent Office in counterpart European Application No. 20161231.4.

* cited by examiner

ELECTRONIC APPARATUS AND METHOD OF CONTROLLING THE SAME

CROSS-REFERENCE TO RELATED APPLICATION

This application is based on and claims priority under 35 U.S.C. § 119 to Korean Patent Application No. 10-2019-0029422 filed on Mar. 14, 2019 in the Korean Intellectual Property Office, the disclosure of which is incorporated by reference herein in its entirety.

BACKGROUND

Field

The disclosure relates to an electronic apparatus of outputting color varied depending on change in brightness of a display and a method of controlling the same.

Description of the Related Art

An electronic apparatus with a display can output content through the display by receiving a signal from the outside or based on previously stored data.

The latest electronic apparatus can change an output brightness value of the display, which outputs the content, based on an illuminance value obtained in an area where the electronic apparatus is placed. For example, the electronic apparatus may use a database in which the brightness values of the display are stored matching the illuminance values to adjust the output brightness value of the display based on the obtained illuminance value.

An electronic apparatus can adjust an output brightness value of a display so that a user can view content matching the user's viewing conditions, but it may be inconvenient for a user because a human does not recognize a color included in the content output through the display as the same as before under the condition that the output brightness value of the display is changed.

SUMMARY

According to an embodiment, there is provided an electronic apparatus including a display configured to output content, a processor and a memory where the memory is configured to store instructions set to instruct the processor to obtain an output brightness value of the display, and change a color parameter of the content output through the display based on a difference between the obtained output brightness value and a reference output brightness value of the display.

The instructions may be set to instruct the processor to, based on the output brightness value being higher than the reference output brightness value, change the color parameter to decrease a wavelength value of a color, the wavelength value being included in a first section of a wavelength range, among colors included in the content output through the display, and change the color parameter to increase a wavelength value of a color, the wavelength value being included in a second section, among the colors included in the content.

The instructions may be set to instruct the processor to, based on the output brightness value lower than the reference output brightness value, change the color parameter to increase a wavelength value of a color, the wavelength value being included in a first section of a wavelength range, among colors included in the content output through the display, and change the color parameter to decrease a wavelength value of a color, the wavelength value being included in a second section of the wavelength range, among the colors included in the content.

The electronic apparatus may further include a backlight unit, and the instructions may be set to instruct the processor to obtain the output bright value by identifying current applied to the backlight unit and a section where the backlight unit is driven.

The color parameter may include at least one of a red (R) value, a green (G) value or a blue (B) value of a color included in the content.

The instructions may be set to instruct the processor to output a notice for informing that the content is output with the color parameter changed based on change in the output brightness value.

The electronic apparatus may further include a communicator configured to establish communication with another electronic apparatus, and the instructions may be set to instruct the processor to control the communicator to transmit a notice informing that the content is output with the color parameter changed based on change in the output brightness value to the another electronic apparatus.

The instructions may be set to instruct the processor to obtain accumulated data about change in the output brightness value, and change the reference output brightness value based on the accumulated data.

The apparatus stores a number of reference output brightness values corresponding to a number of output modes of the electronic apparatus.

The instructions may be set to instruct the processor to change the color parameter, based on an increased difference between the output brightness value and the reference output brightness value.

According to an embodiment, there is provided a method of controlling an electronic apparatus that includes obtaining an output brightness value of a display, identifying a difference between the obtained output brightness value and a reference output brightness value of the display, and changing a color parameter of a color included in content output through the display based on the difference between the output brightness value and the reference output brightness value.

The method may further include, based on the output brightness value being higher than the reference output brightness value, changing the color parameter to decrease a wavelength value of a color, the wavelength value being included in a first section of a wavelength range, among colors included in the content output through the display, and changing the color parameter to increase a wavelength value of a color, the wavelength value being included in a second section, among the colors included in the content.

The method may further include, based on the output brightness value being lower than the reference output brightness value, changing the color parameter to increase a wavelength value of a color, the wavelength value being included in a first section of a wavelength range, among colors included in the content output through the display, and changing the color parameter to decrease a wavelength value of a color, the wavelength value being included in a second section of the wavelength range, among the colors included in the content.

The electronic apparatus may further include a backlight unit, and the method may further include obtaining the output bright value by identifying current applied to the backlight unit and a section where the backlight unit is driven.

The color parameter may include at least one of a red (R) value, a green (G) value or a blue (B) value of a color included in the content.

The method may further include outputting a notice for informing that the content is output with the color parameter changed based on change in the output brightness value.

The electronic apparatus may further include a communicator configured to establish communication with another electronic apparatus, and the method may further include controlling the communicator to transmit a notice, which informs that the content is output with the color parameter changed based on change in the output brightness value, to the another electronic apparatus.

The method may further include obtaining accumulated data about change in the output brightness value, and changing the reference output brightness value based on the accumulated data.

The method may further include changing the color parameter based on an increased difference between the output brightness value and the reference output brightness value.

According to an embodiment, there is provided a computer program product with a computer-readable recording medium configured to store instructions to instruct a computer to obtain an output brightness value of a display, identify a difference between the obtained output brightness value and a reference output brightness value of the display, and change a color parameter of content output through the display based on the difference between the output brightness value and the reference output brightness value.

BRIEF DESCRIPTION OF THE DRAWINGS

The above and/or the aspects will become apparent and more readily appreciated from the following description of exemplary embodiments, taken in conjunction with the accompanying drawings, in which.

DETAILED DESCRIPTION OF EXEMPLARY EMBODIMENTS

Figure 1:
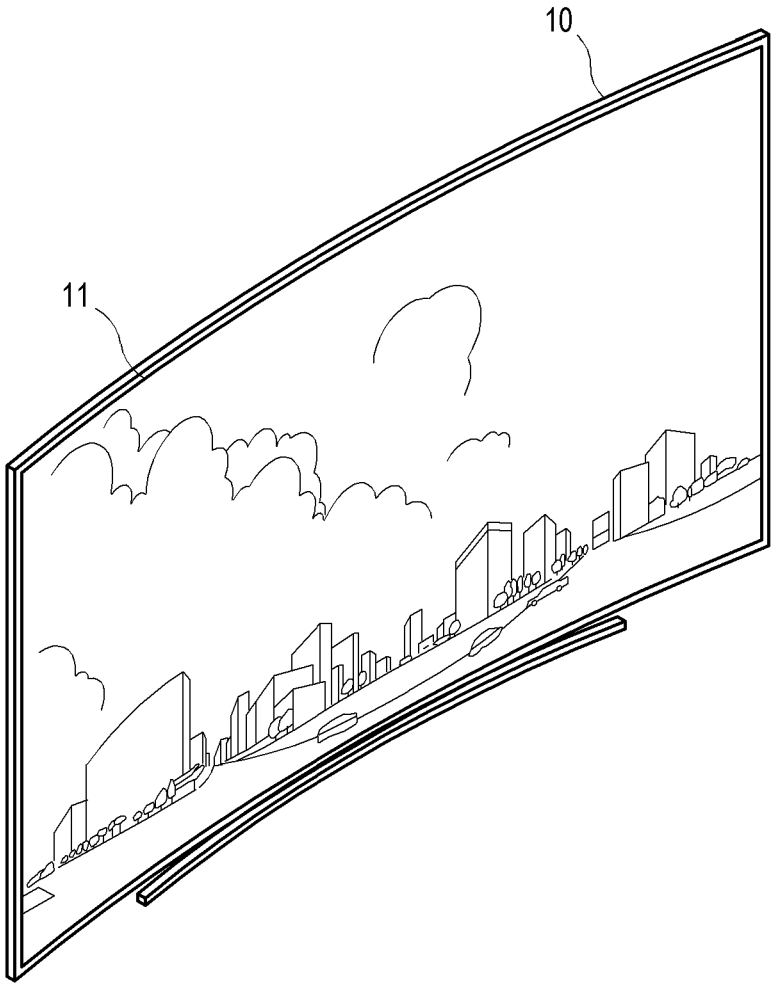
FIG. 1 is a perspective view of an electronic apparatus according to an embodiment.

Below, various embodiments of the disclosure are described with reference to the accompanying drawings. However, these do not intent to limit the disclosure to a specific embodiment form, and it should be understood to include various modifications, equivalents and/or alternatives to the embodiments of the disclosure. Regarding the description of the drawings, like numerals refer to like elements.

In the disclosure, terms "have," "may have," "include," "may include," etc. indicate the presence of corresponding features (e.g. a numeral value, a function, an operation, or an element such as a part, etc.), and do not exclude the presence of additional features.

In the disclosure, terms "A or B", "at least one of A or/and B", "one or more of A or/and B" or the like may include all possible combinations of elements enumerated together. For example, "A or B", "at least one of A and B", or "at least one of A or B" may refer to all of the cases of (1) including at least one A, (2) including at least one B, or (3) including all of at least one A and at least one B.

In the disclosure, the terms "a first", "a second", "the first", "the second", or etc. may modify various elements regardless of order and/or importance, and are just used to distinguish an element from another without limiting the elements. For example, a first user device and a second user device may refer to user devices different from each other regardless of the order or importance of the devices. For instance, a first element may be named a second element without departing from the scope of the present disclosure. Likewise, a second element may also be named a first element.

In the disclosure, terms "module", "unit", "part", etc. are used to denote an element that performs at least one function or operation, and such an element may be achieved by hardware, software or a combination of hardware and software. Further, a plurality of "modules", "units", "parts", etc. may be integrated into at least one module or chip as at least one processor except a case where it needs to be used as each individual specific hardware.

When it is mentioned that a certain element (e.g. a first element) is "(operatively or communicatively) coupled with/to" or "connected to" a different element (e.g. a second element), it will be understood that the certain element may be coupled to the different element directly or through another element (e.g. a third element). On the other hand, when it is mentioned that a certain element (e.g. a first element) is "directly coupled to" or "directly connected to" a different element (e.g. a second element), it will be understood that another elements (e.g. a third element) is not present between the certain element and the different element.

The terms used in the disclosure are used to just describe a specific embodiment, and may not intend to limit the scope of another embodiment. Unless otherwise specified clearly in the context, a singular form may include a plural form. The terms used herein including the technological or scientific terms may have the same meanings as those generally understood by a person having ordinary skill in the art. The terms defined in a general dictionary may be construed as having the same or similar meanings as the contextual meanings of the related art, and are not construed as having ideal or excessively formal meanings unless defined clearly in the disclosure. As necessary, even the terms defined in the disclosure may not be construed as excluding embodiments of the disclosure.

FIG. 1 is a perspective view of an electronic apparatus according to an embodiment.

Referring to FIG. 1, an electronic apparatus 10 may include an image display apparatus (e.g. a television, TV) capable of processing an image signal received from the outside and visually displaying the processed image through a display 11, but is not limited to this example. Alternatively, the electronic apparatus 10 may include an apparatus including a memory and a processor. For example, the electronic apparatus 10 may be achieved by various image display apparatuses such as a mobile phone, a smartphone, a tablet personal computer (PC), a digital camera, a camcorder, a laptop computer, a desktop computer, an E-book terminal, a digital broadcasting terminal, personal digital assistants (PDA), portable multimedia player (PMP), an MP3 player, a wearable device, etc.

According to an alternative embodiment, the electronic apparatus 10 may not include the display 11. For example, the electronic apparatus 10 may include an electronic apparatus that processes an image signal received from the outside, and transmits the processed image signal to an external display apparatus through a separate interface (e.g. high definition multimedia interface (HDMI), a display port (DP), etc.).

According to an embodiment, the electronic apparatus 10 may control the display 11 to output content with a constant output brightness value. The output brightness value may refer to a brightness level of the display 11 that is controlled by the electronic apparatus 10.

According to an embodiment, the electronic apparatus 10 may obtain the output brightness value of the display 11 based on duty information and a current level applied to a backlight unit for illuminating the display 11. The duty information may refer to a ratio of a time period for which the backlight unit actually operates to a time period which one waveform occupies while the backlight unit is driven.

The electronic apparatus 10 may store a default current level applied to the backlight unit, and the output brightness value of the display corresponding to duty of 100%.

To identify the output brightness value, the electronic apparatus 10 may obtain a current level applied to the backlight unit. Further, the electronic apparatus 10 may obtain duty information. For example, when the backlight unit is driven at 120 Hz, a time period that one waveform occupies may be 8.3 ms. The electronic apparatus 10 may obtain a time period for which the backlight unit operates within 8.3 ms occupied by one waveform. For example, when the time period for which the backlight unit is driven is 8.3 ms, the electronic apparatus 10 identifies that the duty is 100%. When the time period for which the backlight unit is driven is 4.15 ms, the electronic apparatus 10 identifies that the duty is 50%.

The electronic apparatus 10 may obtain the output brightness value of the display 11 based on comparison between the obtained duty information and current level applied to the backlight unit and the previously stored 100% duty and default current level applied to the backlight unit.

According to an alternative embodiment, the electronic apparatus 10 may output content through organic light emitting devices included in the display. In this case, the electronic apparatus 10 may obtain the output brightness value of the display based on voltage applied to pixels for reproduction of red (R), green (G) and blue (B) colors. However, the method of obtaining the output brightness value of the display is not limited to this embodiment. The electronic apparatus 10 may obtain the output brightness value of the display by various methods corresponding to a driving principle of the display.

According to an embodiment, the electronic apparatus 10 may change the output brightness value of the display 11.

The electronic apparatus 10 may output a menu for changing the output brightness value of the display 11 through the display 11. A user may use the menu for changing the output brightness value, which is displayed on the display 11, to change the output brightness value of the display 11.

According to an alternative embodiment, the electronic apparatus 10 may change the output brightness value of the display 11 based on a brightness value, which is detected by a sensor module (not shown) including an illuminance sensor, in an area where the electronic apparatus 10 is placed. For example, the electronic apparatus 10 may increase the output brightness value of the display 11 when the brightness value becomes higher in the area where the electronic apparatus 10 is placed, and decrease the output brightness value of the display 11 when the brightness value becomes lower in the area where the electronic apparatus 10 is placed.

According to an embodiment, the electronic apparatus 10 may store a reference output brightness value of the display 11. The reference output brightness value may include a default brightness value set to display content on the display 11. Alternatively, the reference output brightness value may include a reference brightness value set to reproduce color on the display 11.

According to an embodiment, the reference output brightness value may be a single value. Alternatively, the reference output brightness value may include a range value including a preset range. The range value including the preset range may include values higher and/or lower than a single value by about 10%.

According to an embodiment, the electronic apparatus 10 may store a plurality of reference output brightness values. For example, the electronic apparatus 10 may store the plurality of reference output brightness values corresponding to a number of output modes. The output modes may denote that the display outputs content changed in color, brightness or tone according to the features of the output content.

According to an alternative embodiment, the electronic apparatus 10 may include at least one among a standard mode, a movie mode, a dynamic mode or a natural mode. For example, when the electronic apparatus 10 is in the dynamic mode and the natural mode, the output brightness value of the display 11 may be controlled with brightness of 315 nit to 385 nit to output the content. When the electronic apparatus 10 is in the standard mode, the output brightness value of the display 11 may be controlled with brightness of 230 nit to 290 nit to output the content. When the electronic apparatus 10 is in the movie mode, the output brightness value of the display 11 may be controlled with brightness of 198 nit to 220 nit to output the content. However, there are no limits to the output mode. The electronic apparatus 10 may have various output modes in addition to the foregoing output modes. Further, the electronic apparatus 10 may apply a brightness value different from the foregoing brightness values to the foregoing output modes.

Figure 2:
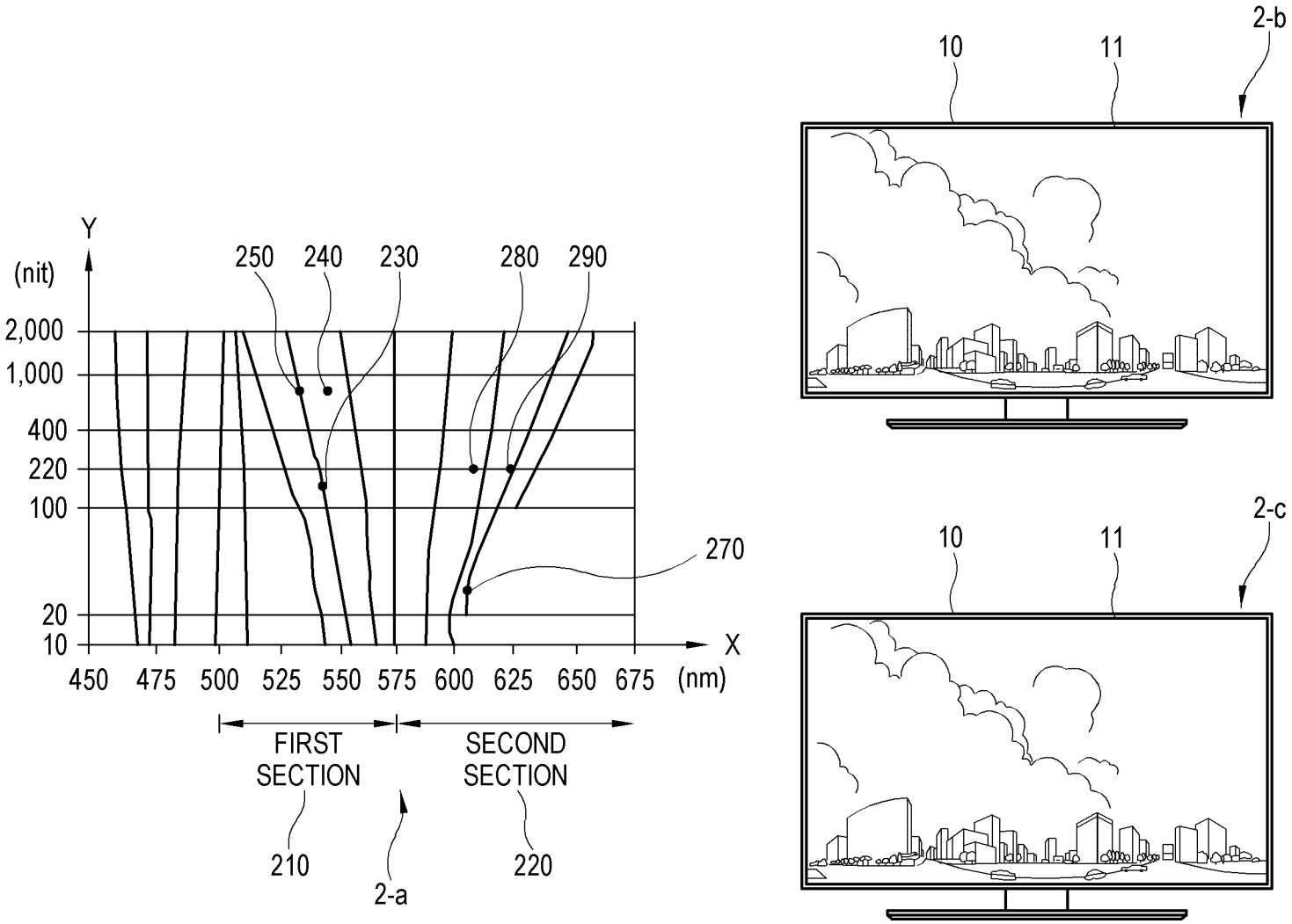
FIG. 2 shows views for describing a situation that an electronic apparatus according to an embodiment changes a color parameter of content output through a display when an output brightness value of the display is higher than a reference output brightness value.

FIG. 2 shows views for describing a situation that an electronic apparatus according to an embodiment changes a color parameter of content output through a display when an output brightness value of the display is higher than a reference output brightness value.

In FIG. 2, '2-*a*' shows a graph of the Bezold Brücke phenomenon that colors are recognized differently according to brightness values. In the graph, X-axis represents a wavelength value of a color, and Y-axis represents an output brightness value of the display 11. For example, the wavelength of the color is given in units of nanometer (nm), and the brightness value is given in units of nit.

According to an alternative embodiment, the output brightness value of the display 11 may be different from the brightness value of when a specific color is output through the display 11. For example, the output brightness value of the display 11 may refer to a brightness value measured with respect to a white signal. The white signal may be calculated based on the sum of brightness values corresponding to R pixel, G pixel and B pixel. Therefore, when the electronic apparatus 10 outputs a single color through the display 11, the output brightness value of the display 11 may be varied depending on a ratio of the single color to the white signal. For example, when the brightness value of the white signal is '1', an R pixel brightness value : a G pixel brightness value : a B pixel brightness value are in a ratio of 0.2126: 0.7152:0.0722.

The graph may show variation in color based on change in the wavelength value between a wavelength 450 nm corresponding to dark blue and a wavelength 675 nm corresponding to dark red.

The graph shows a phenomenon that color change corresponding to the wavelength value is varied depending on the brightness value. For example, when the brightness value is 20 nit, a human may recognize a region near a wavelength value of 550 nm as green. However, when the brightness value is 2000 nit, a human may recognize a region near a wavelength of 550 nm as yellow. Therefore, under the condition that the brightness value is 2000 nit, a human can recognize green at a wavelength of 525 nm.

Further, when the brightness value is 100 nit, a human may recognize a region near a wavelength of 625 nm as dark red. However, when the brightness value becomes 2000 nit, a human may recognize a region near a wavelength value of 620 nm as orange. Therefore, under the condition that the brightness value is 2000 nit, a human can recognize red at a wavelength of 660 nm.

In FIG. 2, '2-*b*' and '2-*c*' illustrate a situation that an electronic apparatus 10 according to an embodiment changes a color parameter of content output through a display as an output brightness value of the display increases.

According to an embodiment, the electronic apparatus 10 may obtain the output brightness value of the display 11, and change the color parameter of the content output through the display 11 when the obtained output brightness value is higher than the reference output brightness value of the display 11.

Referring to '2-*a*' and '2-*b*' in FIG. 2, the electronic apparatus 10 may have the movie mode as the reference output mode. When the reference output mode is the movie mode, the reference output brightness value of the electronic apparatus may be 220 nit. The electronic apparatus 10 may set the output brightness value of the display 11 with a brightness value of 220 nit to reproduce the content. When the electronic apparatus 10 sets the output brightness value of the display 11 with the brightness value of 220 nit, the brightness value for green is 157 nit in the output brightness value of the display 11, and thus a user can recognize green in a region 230 that the electronic apparatus 10 represents with a wavelength value of 530 nm.

Further, when the electronic apparatus 10 sets the output brightness value of the display 11 with the brightness value of 220 nit, the brightness value for red is 46 nit in the output brightness value of the display 11, and thus a user can recognize red in a region 270 that the electronic apparatus 10 represents with a wavelength value of 605 nm.

According to an embodiment, the electronic apparatus 10 may change the output brightness value of the display 11 differently from the reference output brightness value. When the output brightness value of the display 11 is changed differently from the reference output brightness value, the electronic apparatus 10 may change the color parameter of the color included in the content output through the display 11.

For example, the electronic apparatus 10 may adjust R, G and B values of a color (or hue) according to regions of an input image signal (or image content) though an image-quality processing algorithm using hue, saturation and value (HSV) domains.

For example, the electronic apparatus 10 may change the output brightness value in response to a user's input for changing the output brightness value through the menu for changing the output brightness value of the display 11 or the electronic apparatus 10 may change the output brightness value of the display 11 based on an ambient brightness value obtained through an illuminance sensor.

According to an embodiment, the electronic apparatus 10 may change the output brightness value of the display 11 to 1000 nit. When the electronic apparatus 10 sets the output brightness value of the display 11 to the brightness value of 1000 nit, a user may recognize dark green in a region 240 represented at a wavelength value of 530 nm. Further, a user may recognize orange in a region 280 represented at a wavelength of 605 nm.

According to an embodiment, to make a user recognize color as it is even though the output brightness value of the display 11 is changed, the electronic apparatus 10 may change the color parameter included in the content output through the display 11. The color parameter may include at least one of R, G and B values included in the color.

Referring to '2-*a*' in FIG. 2, the electronic apparatus 10 may change the color parameter to decrease the wavelength value of a color, the wavelength value being included in a first section 210 corresponding to a predetermined wavelength range, among the colors included in the content output through the display 11. The first section 210 may refer to a section in which the wavelength value of the color ranges from 500 nm to 575 nm. The change in the color parameter to decrease the wavelength value of the color may refer to change in the color parameter to represent hue of a short wavelength value.

Referring to '2-*a*' in FIG. 2, when the electronic apparatus 10 sets the output brightness value of the display 11 to the brightness value of 1000 nit, a user may recognize green in a region 250 represented at a wavelength value of 530 nm because a brightness value corresponding to green is 715 nit in the output brightness value of the display 11. Therefore, the electronic apparatus 10 may change at least one among R, G and B values to thereby make a user recognize yellow-green as provided as before. For example, the electronic apparatus 10 may set green to be recognizable in the region 250 represented at the wavelength of 520 nm. Thus, a user can recognize the same green as before even though the output brightness value is changed.

According to an alternative embodiment, the electronic apparatus 10 may change the color parameter as a difference between the identified output brightness value and the reference output brightness value is continuously increased. For example, the electronic apparatus 10 may change one among R, G and B values when the output brightness value of the display 11 is increased higher than 1000 nit. Thus, a user may recognize the same green as before even though the output brightness value is changed.

Referring to '2-*a*' in FIG. 2, the electronic apparatus 10 may change the color parameter to increase the wavelength value of a color, the wavelength value being included in a second section 220 corresponding to a predetermined wavelength range, among the colors included in the content output through the display 11. The second section 220 may refer to a section in which the wavelength value of the color is above 575 nm. The change in the color parameter to increase the wavelength value of the color may refer to change in the color parameter to represent hue of a long wavelength value.

Referring to '2-*c*' in FIG. 2, when the electronic apparatus 10 sets the output brightness value of the display 11 to the brightness value of 1000 nit, a user may recognize red in a region 280 represented at a wavelength value of 605 nm because a brightness value corresponding to red is 212 nit in the output brightness value of the display 11. Therefore, the electronic apparatus 10 may change at least one among R, G and B values to thereby make a user recognize red as provided as before. For example, the electronic apparatus 10 may set red to be recognizable in a region 290 represented at the wavelength of 620 nm. Thus, a user can recognize the same red as before even though the output brightness value is changed.

According to an alternative embodiment, the electronic apparatus 10 may change the color parameter as a difference between the identified output brightness value and the reference output brightness value is continuously increased. For example, the electronic apparatus 10 may change one among R, G and B values when the output brightness value of the display 11 is increased higher than 1000 nit. Thus, a user may recognize the same red as before even though the output brightness value is changed.

Like this, the electronic apparatus 10 can change the color parameter based on the change in the output brightness value of the display 11 by the foregoing method. Thus, a user who watches content through the display 11 recognizes a constant color regardless of change in the brightness of the display 11.

Figure 3:
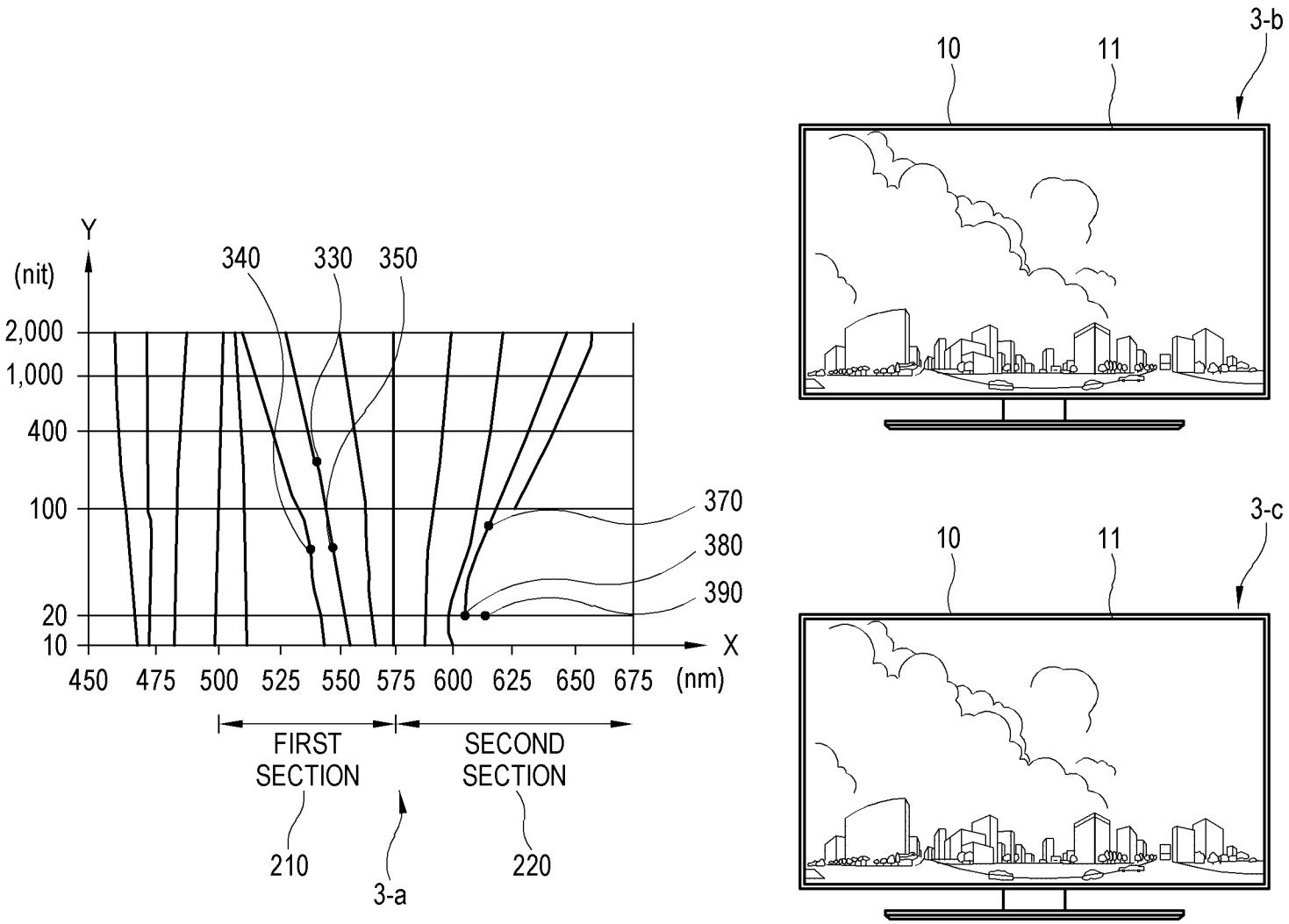
FIG. 3 shows views for describing a situation that an electronic apparatus according to an embodiment changes a color parameter of content output through a display when an output brightness value of the display is lower than a reference output brightness value.

FIG. 3 shows views for describing a situation that an electronic apparatus according to an embodiment changes a color parameter of content output through a display when an output brightness value of the display is lower than a reference output brightness value.

In FIG. 3, '3-*a*' shows a graph of the Bezold Brücke phenomenon that colors are recognized differently according to brightness values. In the graph, X-axis represents a wavelength value of a color, and Y-axis represents an output brightness value of the display 11. For example, the wavelength of the color is given in units of nanometer (nm), and the brightness value is given in units of nit. The description about the graph will be omitted since it has already been described with '2-*a*' in FIG. 2.

In FIG. 3, '3-*b*' and '3-*c*' illustrate a situation that an electronic apparatus 10 according to an embodiment changes a color parameter of content output through a display 11 as an output brightness value of the display 11 decreases.

According to an embodiment, the electronic apparatus 10 may obtain the output brightness value of the display 11, and change the color parameter of the content output through the display when the obtained output brightness value is lower than the reference output brightness value of the display.

Referring to '3-*b*' in FIG. 3, the electronic apparatus 10 may have the movie mode as the reference output mode. When the reference output mode is the movie mode, the reference output brightness value of the electronic apparatus may be 400 nit. The electronic apparatus 10 may set the output brightness value of the display 11 with a brightness value of 400 nit to reproduce the content. When the electronic apparatus 10 sets the output brightness value of the display 11 with the brightness value of 400 nit, the brightness value for green is 286 nit in the output brightness value of the display 11, and thus a user can recognize green in a region 230 that the electronic apparatus 10 represents with a wavelength value of 525 nm.

Further, when the electronic apparatus 10 sets the output brightness value of the display 11 with the brightness value of 400 nit, the brightness value for red is 85 nit in the output brightness value of the display 11, and thus a user can recognize red in a region 370 that the electronic apparatus 10 represents with a wavelength value of 615 nm.

According to an embodiment, the electronic apparatus 10 may change the output brightness value of the display 11 differently from the reference output brightness value. When the output brightness value of the display 11 is changed differently from the reference output brightness value, the electronic apparatus 10 may change the color parameter of the color included in the content output through the display 11.

For example, the electronic apparatus 10 may adjust R, G and B values of a color (or hue) according to regions of an input image signal though an image-quality processing algorithm using HSV domains.

For example, the electronic apparatus 10 may change the output brightness value in response to a user's input for changing the output brightness value through the menu for changing the output brightness value of the display 11 or the electronic apparatus 10 may change the output brightness value of the display 11 based on an ambient brightness value obtained through an illuminance sensor.

According to an embodiment, the electronic apparatus 10 may change the output brightness value of the display 11 to 100 nit. When the electronic apparatus 10 sets the output brightness value of the display 11 to the brightness value of 100 nit, a user may recognize blue green in a region 340 represented at a wavelength value of 525 nm. Further, a user may recognize orange in a region 380 represented at a wavelength of 615 nm.

According to an embodiment, to make a user recognize color as it is even though the output brightness value of the display 11 is changed, the electronic apparatus 10 may change the color parameter of the content output through the display 11. The color parameter may include at least one of R, G and B values included in the color.

Referring to '3-*a*' in FIG. 3, the electronic apparatus 10 may change the color parameter to increase the wavelength value of a color, the wavelength value being included in a first section 210 corresponding to a predetermined wavelength range, among the colors included in the content output through the display 11. The first section 210 may refer to a section in which the wavelength value of the color ranges from 500 nm to 575 nm. The change in the color parameter to increase the wavelength value of the color may refer to change in the color parameter to represent hue of a long wavelength value.

Referring to '3-*a*' in FIG. 3, when the electronic apparatus 10 sets the output brightness value of the display 11 to the brightness value of 100 nit, a user may recognize green in a region 350 represented at a wavelength value of 525 nm because a brightness value corresponding to green is 71 nit in the output brightness value of the display 11. Therefore, the electronic apparatus 10 may change at least one among R, G and B values to thereby make a user recognize green as provided as before. For example, the electronic apparatus 10 may set green to be recognizable in the region 350 represented at the wavelength of 535 nm. Thus, a user can recognize the same green as before even though the output brightness value is changed.

According to an alternative embodiment, the electronic apparatus 10 may change the color parameter as a difference between the identified output brightness value and the reference output brightness value is continuously increased. For example, the electronic apparatus 10 may change one among R, G and B values when the output brightness value of the display 11 is decreased lower than 100 nit. Thus, a user may recognize the same green as before even though the output brightness value is changed.

Referring to '3-*a*' in FIG. 3, the electronic apparatus 10 may change the color parameter to decrease the wavelength value of a color, the wavelength value being included in a second section 220 corresponding to a predetermined wavelength range, among the colors included in the content output through the display 11. The second section 220 may refer to a section in which the wavelength value of the color is above 575 nm. The change in the color parameter to decrease the wavelength value of the color may refer to change in the color parameter to represent hue of a short wavelength value.

Referring to '3-*c*' in FIG. 3, when the electronic apparatus 10 sets the output brightness value of the display 11 to the brightness value of 100 nit, a user may recognize red in a region 380 represented at a wavelength value of 610 nm because a brightness value corresponding to red is 21 nit in the output brightness value of the display 11. Therefore, the electronic apparatus 10 may change at least one among R, G and B values to thereby make a user recognize red as provided as before. For example, the electronic apparatus 10 may set red to be recognizable in a region 390 represented at the wavelength of 595 nm. Thus, a user can recognize the same red as before even though the output brightness value is changed.

According to an alternative embodiment, the electronic apparatus 10 may change the color parameter as a difference between the identified output brightness value and the reference output brightness value is continuously increased. For example, the electronic apparatus 10 may change one among R, G and B values when the output brightness value of the display 11 is decreased lower than 100 nit. Thus, a user may recognize the same red as before even though the output brightness value is changed.

Like this, the electronic apparatus 10 can change the color parameter based on the change in the output brightness value of the display 11 by the foregoing method. Thus, a user who watches content through the display 11 recognizes a constant color regardless of change in the brightness of the display 11.

Figure 4:
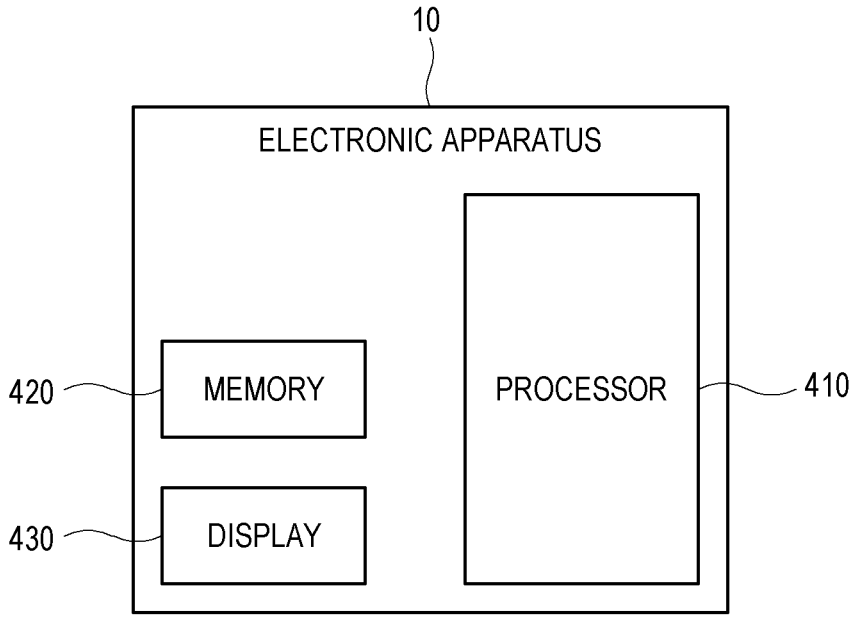
FIG. 4 is a schematic block diagram of an electronic apparatus according to an embodiment.

FIG. 4 is a schematic block diagram of an electronic apparatus according to an embodiment.

Referring to FIG. 4, the electronic apparatus 10 may include a processor 410, a memory 420, and a display 430. However, there are no limits to this embodiment. The electronic apparatus 10 may exclude some elements, or may additionally include other elements. For example, the electronic apparatus 10 may further include a communicator (not shown) to communicate with other electronic apparatuses or servers.

According to an embodiment, the processor 410 may control the memory 420 to execute a program stored in the memory 420, and load or store necessary information.

For example, the processor 410 may obtain an output brightness value of the display 430, and change a color parameter of a color included in content output through the display 430 when the obtained output brightness value is different from a reference output brightness value of the display 430.

According to an embodiment, the memory 420 may be configured to store a program for processing and controlling the processor 410, and data input to the electronic apparatus 10 or output from the electronic apparatus 10.

For example, the memory may be configured to store instructions set to obtain the output brightness value of the display 430, and change the color parameter of the color included in the content output through the display 430 when the obtained output brightness value is different from the reference output brightness value of the display 430.

According to an embodiment, the display 430 may be configured to display an image or a moving image, and/or a running screen of an application. The display 430 may include the display 11 of FIG. 1. When the display 430 is achieved by a touch-screen display, the display 430 may be used as an input device as well as an output device. The display 430 may include at least one among a liquid crystal display, a thin film transistor-liquid crystal display, an organic light-emitting diode, a flexible display, a three-dimensional (3D) display, and an electrophoretic display.

Figure 5:
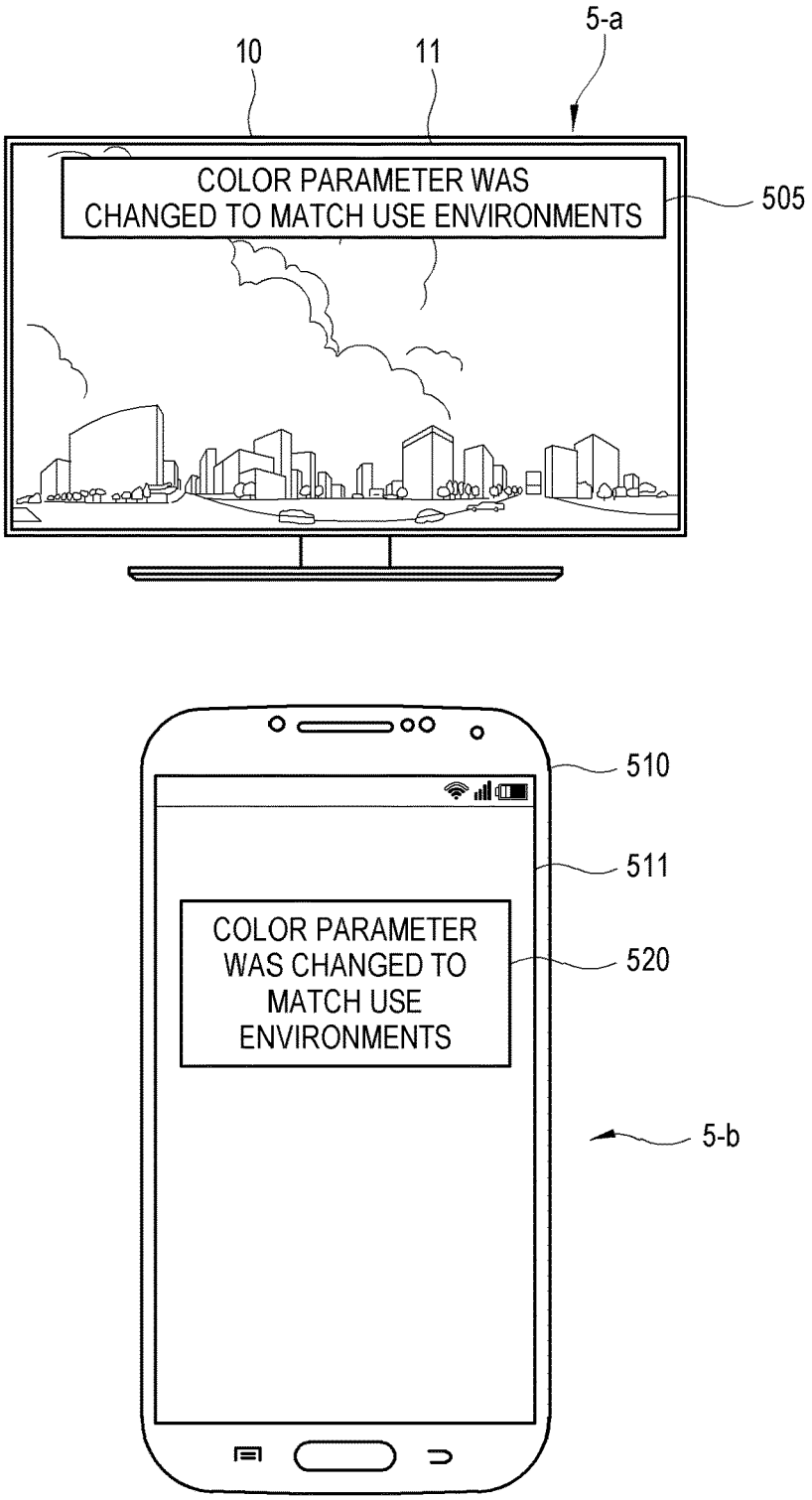
FIG. 5 shows views for describing a situation that an electronic apparatus according to an embodiment displays information about change in a color parameter.

FIG. 5 shows views for describing a situation that an electronic apparatus according to an embodiment displays information about change in a color parameter.

Referring to '5-*a*' in FIG. 5, the electronic apparatus 10 may display a notice 505, which informs a user that content is output with a changed color parameter, on the display 11 when the content is output with the color parameter changed corresponding to change in the output brightness value of the display 11.

Referring to '5-*b*' in FIG. 5, another electronic apparatus 510 may display a notice 520 for informing that the color parameter is changed based on change in the output brightness value of the display 11 included in the electronic apparatus 10. For example, the electronic apparatus 10 may establish communication with the another electronic apparatus 510. The another electronic apparatus 510 receives the notice, which informs that the color parameter is changed based on the change in the output brightness value of the display 11, from the electronic apparatus 10, and displays the notice on its own display 511.

In other words, when the electronic apparatus 10 is a communal apparatus such as a TV and the another electronic apparatus 510 is a smartphone, a tablet PC or the like personal apparatus, a user may check whether the color parameter is changed based on change in the output brightness value of the TV, through the smartphone or the like personal apparatus.

Figure 6:
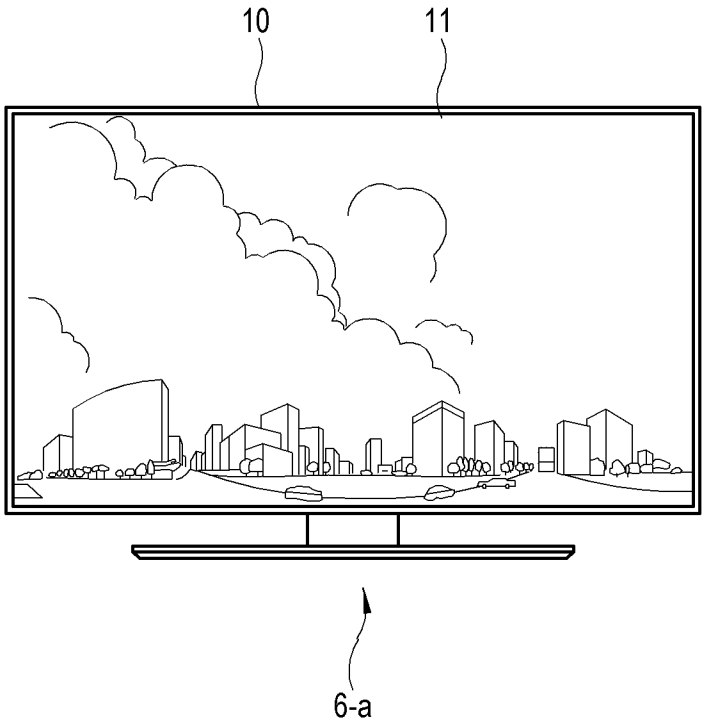
FIG. 6 shows views for describing a situation that an electronic apparatus according to an embodiment changes a basic output brightness value based on accumulated output brightness values of the display.
Figure 6:
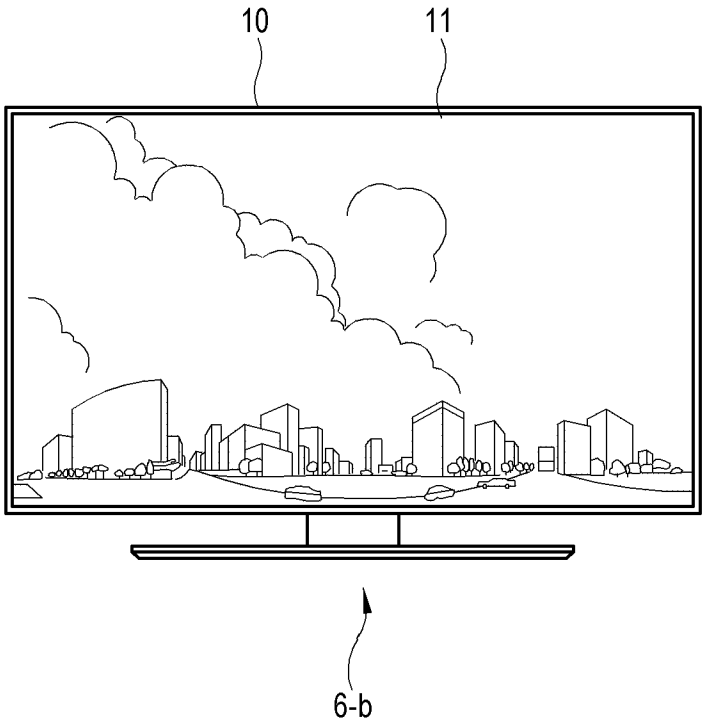

FIG. 6 shows views for describing a situation that an electronic apparatus according to an embodiment changes a default output brightness value based on accumulated output brightness values of the display.

Referring to '6-*a*' in FIG. 6, the electronic apparatus 10 may control the display 11 to output content with a constant output brightness value. For example, the electronic apparatus 10 may output content with a reference output brightness value.

According to an embodiment, the electronic apparatus 10 may set a color parameter of the content output through the display 11 based on the reference output brightness value. For example, the electronic apparatus 10 may represent red corresponding to a wavelength value of 640 nm when the display 11 outputs content with a reference output brightness value of 400 nit.

According to an embodiment, the electronic apparatus 10 may store the reference output brightness value of the display 11. The reference output brightness value may be a default brightness value set when the display 11 outputs the content. Alternatively, the reference output brightness value may be a brightness value set as a reference for representing color in the display 11.

According to an embodiment, the electronic apparatus 10 may change the output brightness value of the display 11. The electronic apparatus 10 may output a menu for changing the output brightness value of the display 11 to the display 11. A user may change the output brightness of the display 11 through the menu for changing the output brightness value displayed on the display 11.

As described above in FIGS. 2 and 3, the electronic apparatus 10 may change the color parameter of the color included in the content output though the display, based on the changed output brightness value of the display 11.

According to an embodiment, the electronic apparatus 10 may store a history that the output brightness value of the display 11 has been changed. For example, the electronic apparatus 10 may store a history that the output brightness value of the display 11 has been changed for a preset period of time (e.g. three months to one year).

According to an embodiment, when a case where the output brightness value of the display 11 is set to a specific value different from the reference output brightness value for a preset period of time corresponds to a preset proportion (e.g. over 80% of the preset period of time), the electronic apparatus 10 may change the reference output brightness value of the display 11 to the specific value.

Referring to '6-*b*' in FIG. 6, it is identified that the electronic apparatus 10 having a reference output brightness value of 400 nit sets the display 111 with an output brightness value of 100 nit for over 80% of the preset period of time. In this case, the electronic apparatus 10 may change the reference output brightness value to 100 nit.

The electronic apparatus 10 may output content with the changed reference output brightness value. For example, the electronic apparatus 10 may represent red at a wavelength value of 625 nm when the display 11 outputs content with the reference output brightness value of 100 nit.

Figure 7:
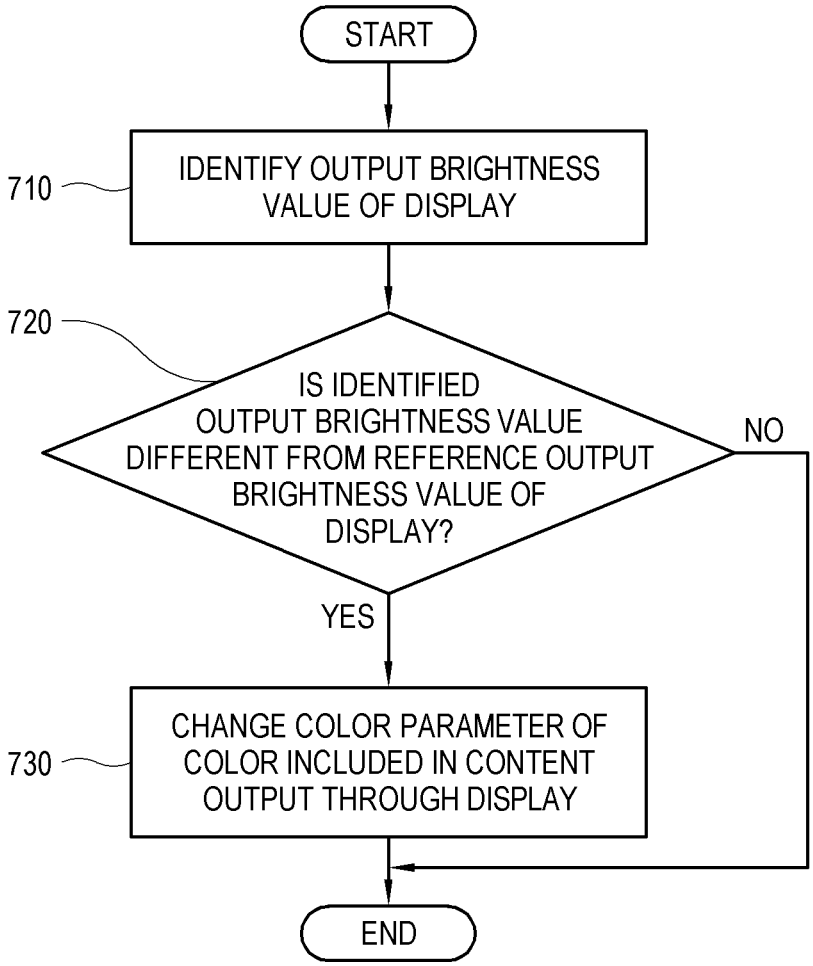
FIG. 7 is a flowchart for describing a situation that an electronic apparatus according to an embodiment changes a color parameter of content output through a display based on change in an output brightness value of the display.

FIG. 7 is a flowchart for describing a situation that an electronic apparatus according to an embodiment changes a color parameter of content output through a display, based on change in an output brightness value of the display.

At operation 710, the electronic apparatus 10 may identify the output brightness value of the display 11. The output brightness value may refer to the brightness value of the display 11 controlled by the electronic apparatus 10.

According to an embodiment, the electronic apparatus 10 may obtain the output brightness value of the display 11, based on duty information and a current level applied to the backlight unit for illuminating the display 11. The duty information may for example refer to a ratio of a time period for which the backlight unit actually operates to a time period which one waveform occupies while the backlight unit is driven.

According to an alternative embodiment, the electronic apparatus 10 may output content through organic light emitting devices included in the display 11. In this case, the electronic apparatus 10 may obtain the output brightness of the display 11 based on voltage applied to pixels for reproduction of R, G, B colors. However, the method of obtaining the output brightness of the display is not limited to this embodiment. The electronic apparatus 10 may obtain the output brightness value of the display by various methods corresponding to a driving principle of the display.

At operation 720, the electronic apparatus 10 may identify whether the identified output brightness value is different from the reference output brightness value of the display 11.

According to an embodiment, the electronic apparatus 10 may change the output brightness value of the display 11.

The electronic apparatus 10 may output the menu, through which the output brightness value of the display 11 is changed, to the display 11. A user may change the output brightness of the display 11 through the menu for changing the output brightness value displayed on the display 11.

According to an alternative embodiment, the electronic apparatus 10 may change the output brightness value of the display 11 based on a brightness value, which is detected by the sensor module including the illuminance sensor, in an area where the electronic apparatus 10 is placed. For example, the electronic apparatus 10 may increase the output brightness value of the display 11 when the brightness value becomes higher in the area where the electronic apparatus 10 is placed, and decrease the output brightness value of the display 11 when the brightness value becomes lower in the area where the electronic apparatus 10 is placed.

At operation 730, when the identified output brightness value is different from the reference output brightness value of the display 11, the electronic apparatus 10 may change the color parameter of the color included in the content output through the display 11.

According to an embodiment, to make a user recognize color as it is even though the output brightness value of the display 11 is changed, the electronic apparatus 10 may change the color parameter of the color included in the content output through the display 11. The color parameter may include at least one of R, G and B values included in the color.

For example, the electronic apparatus 10 may change the color parameter to decrease the wavelength value of the color. The change in the color parameter to decrease the wavelength value of the color may refer to change in the color parameter to represent hue of a short wavelength value.

Alternatively, the electronic apparatus 10 may change the color parameter to increase the wavelength value of the color. The change in the color parameter to increase the wavelength value of the color may refer to change in the color parameter to represent hue of a long wavelength value.

When the identified output brightness value is not different from the reference output brightness value of the display 11, the electronic apparatus 10 may output content without changing the color parameter.

Figure 8:
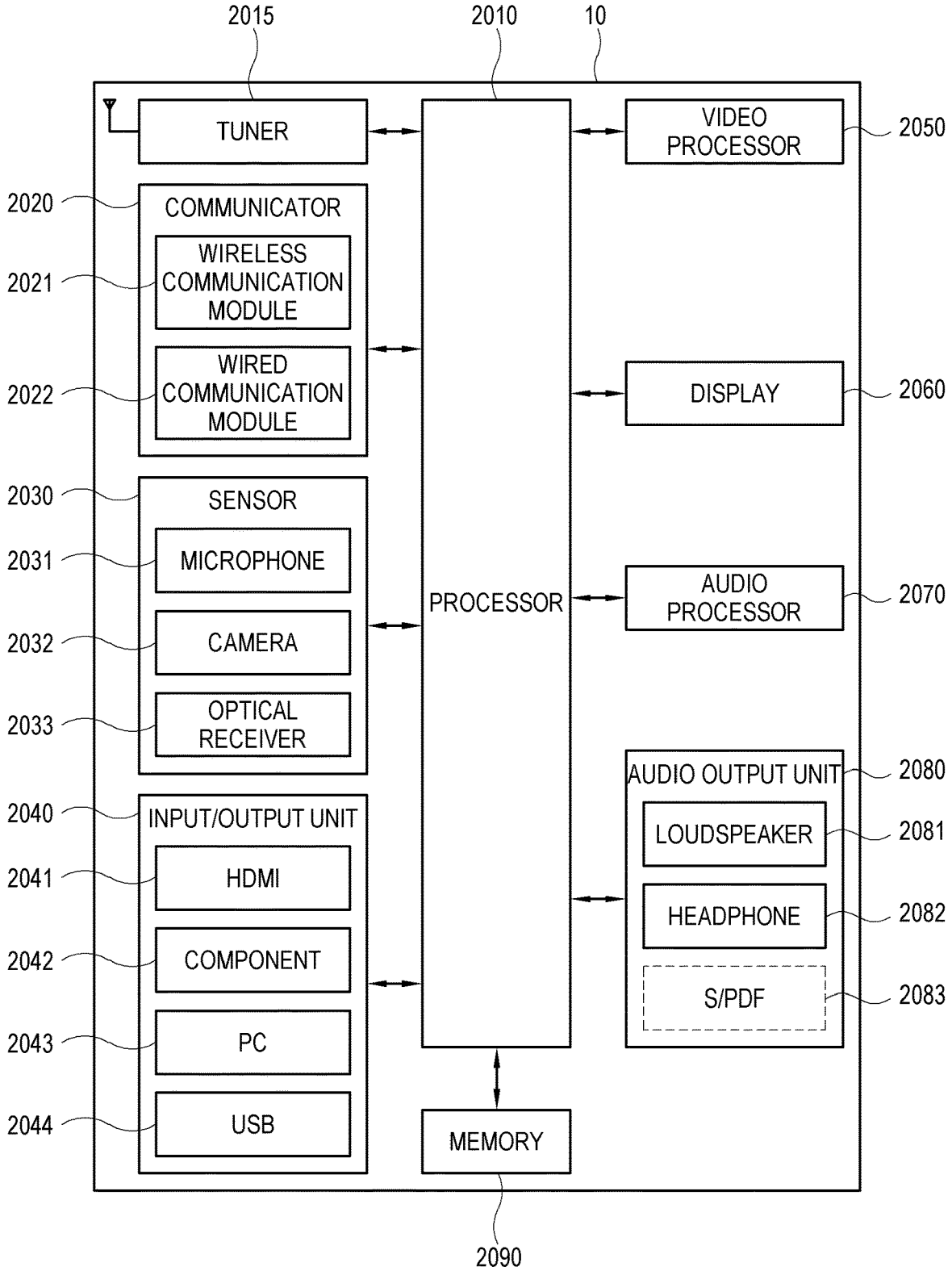
FIG. 8 is a block diagram of an electronic apparatus according to an alternative embodiment of the disclosure.

FIG. 8 is a block diagram of an electronic apparatus according to an alternative embodiment of the disclosure.

As shown in FIG. 8, the electronic apparatus 10 may further include at least one of a communicator 2020, a tuner 2015, a sensor 2030, an input/output unit 2040, a video processor 2050, an audio processor 2070, or an audio output unit 2080 in addition to a processor 2010, a memory 2090 and a display 2060.

The processor 2010, the memory 2090 and the display 2060 may correspond to the processor 410, the memory 420, the display 430 of FIG. 4, respectively.

The processor 2010 may execute software (e.g. a program) stored in the memory 2090 to control at least one of other elements (e.g. hardware or software elements) of the electronic apparatus 10 connected to the processor 2010, and perform various data processes or operations. According to an embodiment, as at least a part of the data process or operation, the processor 2010 may load an instruction or data received from other elements to the memory (e.g. a volatile memory) 2090, process the instruction or data stored in the memory 2090, and store result data in a memory (e.g. a nonvolatile memory). According to an embodiment, the processor 2010 may include a main processor (e.g. a central processing unit or an application processor), and an auxiliary processor (e.g. a graphic processing unit, an image signal processor, a sensor hub processor, or a communication processor) operable independently of or together with the main processor. Additionally or alternatively, the auxiliary processor may be set to use lower power than the main processor, or be specified to a designated function. The auxiliary processor may be achieved separately from or as a part of the main processor. The auxiliary processor may control at least a part of functions or states related to at least one element among the elements of the electronic apparatus 10, instead of the main processor while the main processor is in an inactive (e.g. sleeping) mode, or together with the main processor while the main processor is in an active (e.g. application-running) mode.

The communicator 2020 may connect the electronic apparatus 10 with an external apparatus, a server, etc. under control of the processor 2010. The communicator 2020 may include one or more communication processors operable independently of the processor 2010 (e.g. the application processor), and supporting direct (e.g. wired) communication or wireless communication. According to an embodiment, the communicator 2020 may include a wireless communication module 2021 (e.g. a cellular communication module, a near field wireless communication module, or a global navigation satellite system (GNSS) communication module) or a wired communication module 2022 (e.g. a local area network (LAN) communication module, or a power line communication module). Among these communication modules, a corresponding communication module may communicate with the server through a first network (e.g. Bluetooth, Wi-Fi direct, infrared data association (IrDA), or the like short range communication network) or a second network (e.g. a cellular network, Internet, a computer network (e.g. LAN or WAN) or the like long range communication network). Such many kinds of communication modules may be integrated into one element (e.g. a single chip) or a plurality of elements (e.g. a plurality of chips) separated from one another.

The display 2060 may visually provide information (e.g. a user interface (UI), etc.) to the outside (e.g. a user) of the electronic apparatus 10. When the display 2060 and a touch pad form a layered structure as a touch screen, the display 2060 may be used as an input device as well as an output device. The display 2060 may include at least one among a liquid crystal display, a thin film transistor-liquid crystal display, an organic light-emitting diode, a flexible display, a three-dimensional (3D) display, and an electrophoretic display. In addition, the electronic apparatus 10 may be configured to include two or more displays 2060.

The tuner 2015 may be tuned to only a frequency of a channel desired in the electronic apparatus 10 and selectively receive a broadcast signal among many radio wave components by applying amplification, mixing, resonance, etc. to the broadcast signal received by a wire or wirelessly. The broadcast signal includes an audio signal, a video signal, and appended information (e.g. an electronic program guide (EPG)).

The broadcast signal received through the tuner 2015 is subjected to decoding (e.g. audio signal decoding, video signal decoding, or appended information decoding) and split into the audio signal, the video signal, and/or appended information. The split audio signal, video signal, and appended information may be stored in the memory 2090 under control of the processor 2010. The electronic apparatus 10 may include a single tuner 2015 or a plurality of tuners 2015. The tuner 2015 may be achieved by an all-in-one device together with the electronic apparatus 10, a separate device electrically connected to the electronic apparatus 10 and including a tuner unit, or a tuner part (not shown) connected to the input/output unit 2040.

The sensor 2030 is configured to detect a user's voice, a user's image, or a user's interaction, and may include a microphone 2031, a camera 2032, and an optical receiver 2033.

The microphone 2031 receives a voice uttered by a user. The microphone 2031 converts the received voice into an electric signal and outputs the electric signal to the processor 2010. The camera 2032 may receive images (e.g. successive frames) corresponding to a user's motion including a gesture within a camera recognition range. The optical receiver 2033 receives an optical signal with a control signal received from an external control device (e.g. a remote controller). The optical receiver 2033 may receive an optical signal corresponding to a user's input (e.g. touch, press, touching gesture, voice, or motion) from a control device. Under the control of the processor 2010, a control signal may be extracted from the received optical signal.

The input/output unit 2040 receives a video signal (e.g. a moving image, etc.), an audio signal (e.g., a voice, music, etc.), and appended information (e.g. EPG, etc.) from the outside of the electronic apparatus 10 under control of the processor 2010. The input/output unit 2040 may include one among an HDMI port 2041, a component jack 2042, a PC port 2043, and a universal serial bus (USB) port 2044. The input/output unit 2040 may include combination of the HDMI port 2041, the component jack 2042, the PC port 2043, and the USB port 2044.

The video processor 2050 processes an image to be displayed by the display 2060, and performs various image processes such as video data decoding, scaling, noise filtering, frame rate conversion, resolution conversion, etc.

The audio processor 2070 processes audio data. The audio processor 2070 may perform various processes such as decoding, amplification, noise filtering, etc. with regard to audio data.

The audio output unit 2080 may output a sound included in a broadcast signal received through the tuner 2015 under control of the processor 2010, a sound received through the communicator 2020 or the input/output unit 2040, or a sound stored in the memory 2090. The audio output unit 2080 may include at least one of a loudspeaker 2081, a headphone output terminal 2082, or an Sony/Philips digital interface (S/PDIF) output terminal 2083.

According to an embodiment, the memory 2090 may be configured to store a program for process and control of the processor 2010, and store data input to the electronic apparatus 10 or output from the electronic apparatus 10.

The memory 2090 may include a storage medium of at least one type among a flash memory type, a hard disk type, a multimedia card micro type, a card type (e.g. SD or XD memory, etc.), a random access memory (RAM), a static random access memory (SRAM), a read-only memory (ROM), an electrically erasable programmable read-only memory (EEPROM), a programmable read-only memory (PROM), a magnetic memory, a magnetic disc, or an optical disc.

Various embodiments of the disclosure may be achieved as software (e.g. the program) including one or more instructions stored in a storage medium (e.g. the memory 2090) readable by a machine (e.g. the electronic apparatus 10). For example, the processor (e.g. the processor 2010) of the machine (e.g. the electronic apparatus 10) may call at least one instruction among one or more stored instructions from the storage medium, and execute the called instruction. This makes it possible to operate the machine to perform at least one function based on at least one called instruction. The one or more instructions may include a code created by a compiler or executable by an interpreter. Such a machine-readable storage medium may be given in the form of a non-transitory storage medium. Here, the term 'non-transitory' just means that the storage medium is tangible excluding a signal (e.g. an electromagnetic wave), and does not distinguish between a case where data is semi-permanently stored in the storage medium and a case where data is transitorily stored in the storage medium.

According to an embodiment, a method according to various embodiments of the disclosure may be provided as involved in a computer program product. The computer program product may be traded as goods a commodity between a seller and a purchaser. The computer program product may be distributed in the form of a machine-readable storage medium (e.g. a compact disc read only memory (CD-ROM)), or may be distributed (e.g. downloaded or uploaded) directly between two user devices through an application store (e.g. the Play Store™) or through the Internet. In a case of the Internet distribution, at least a part of the computer program product may be at least transitorily stored or temporarily generated in a machine-readable storage medium such as a server of a manufacturer, a server of the application store, or a memory of a relay server.

According to various embodiments, each of the foregoing elements (e.g. the modules or the programs) may include a single object or a plurality of objects. According to various embodiments, one or more elements among the foregoing elements or operations may be omitted, or one or more other elements or operations may be added. Alternatively or additionally, the plurality of elements (e.g. the modules or the programs) may be integrated into one element. In this case, the integrated element may perform the same or similar one or more functions of each element among the plurality of elements as performed by the corresponding element among the plurality of elements before the integration. According to various embodiments, the operations performed by the modules, the programs or other elements may be performed sequentially, parallelly, repetitively or heuristically, or one or more among the operations may be carried out in different order, omitted, or added with one or more other operations.

According to an embodiment of the disclosure, an electronic apparatus may change a color, which is included in content output through a display, based on change in an output brightness value of the display so that a user can recognize colors as a constant color.

According to an embodiment of the disclosure, an electronic apparatus may provide a notice for informing that a color included in content is varied depending on change in an output brightness value.

According to an embodiment of the disclosure, an electronic apparatus may change a color, which is included in content output through a display, based on change in an output brightness value of the display and a reference output brightness value of the display so that a user can recognize colors as a constant color.

Although a few exemplary embodiments have been shown and described, it will be appreciated by those skilled in the art that changes may be made in these exemplary embodiments without departing from the principles and spirit of the invention, the scope of which is defined in the appended claims and their equivalents.

What is claimed is:

1. An electronic apparatus comprising:

a display configured to output content;

a processor; and a memory, wherein the memory is configured to store instructions set to instruct the processor to:

obtain an output brightness value of the display, compare the obtained output brightness value and a reference output brightness value of the display, identify a wavelength value of a color included in the content output through the display, identify a section to which the identified wavelength value belongs among a first section and a second section, the first section corresponding to a wavelength range in which the wavelength value is lower than a predetermined value and the second section corresponding to a wavelength range in which the wavelength value is above the predetermined value, based on the comparing, change a color parameter to increase or decrease the wavelength value of the color corresponding to the section to which the identified wavelength value belongs, and output the content through the display based on the changed color parameter.

2. The electronic apparatus according to claim 1, wherein the instructions are set to instruct the processor to:

based on the comparing being identified that the output brightness value is higher than the reference output brightness value, change the color parameter to decrease a wavelength value of a color, the wavelength value being included in the first section, among colors included in the content output through the display, and change the color parameter to increase a wavelength value of a color, the wavelength value being included in the second section, among the colors included in the content.

3. The electronic apparatus according to claim 1, wherein the instructions are set to instruct the processor to:

based on the comparing being identified that the output brightness value is lower than the reference output brightness value, change the color parameter to increase a wavelength value of a color, the wavelength value being included in the first section, among colors included in the content output through the display, and change the color parameter to decrease a wavelength value of a color, the wavelength value being included in the second section, among the colors included in the content.

4. The electronic apparatus according to claim 1, further comprising a backlight unit, wherein the instructions are set to instruct the processor to obtain the output brightness value by identifying current applied to the backlight unit and a section where the backlight unit is driven.

5. The electronic apparatus according to claim 1, wherein the color parameter comprises at least one of a red (R) value, a green (G) value or a blue (B) value of a color included in the content.

6. The electronic apparatus according to claim 1, wherein the instructions are set to instruct the processor to output a notice for informing that the content is output with the color parameter changed based on change in the output brightness value.

7. The electronic apparatus according to claim 1, further comprising a communicator configured to establish communication with another electronic apparatus, wherein the instructions are set to instruct the processor to control the communicator to transmit a notice informing that the content is output with the color parameter changed based on change in the output brightness value to the another electronic apparatus.

8. The electronic apparatus according to claim 1, wherein the instructions are set to instruct the processor to obtain accumulated data about change in the output brightness value, and change the reference output brightness value based on the accumulated data.

9. The electronic apparatus according to claim 1, wherein the apparatus stores a number of reference output brightness values corresponding to a number of output modes of the electronic apparatus.

10. The electronic apparatus according to claim 1, wherein the instructions are set to instruct the processor to change the color parameter based on an increased difference between the output brightness value and the reference output brightness value.

11. A method of controlling an electronic apparatus, comprising:

obtaining an output brightness value of a display;

comparing the obtained output brightness value and a reference output brightness value of the display;

identifying a wavelength value of a color included in a content output through the display;

identifying a section to which the identified wavelength value belongs among a first section and a second section, the first section corresponding to a wavelength range in which the wavelength value is lower than a predetermined value and the second section corresponding to a wavelength range in which the wavelength value is above the predetermined value;

based on the comparing, changing a color parameter to increase or decrease the wavelength value of the color corresponding to the section to which the identified wavelength value belongs; and outputting the content through the display based on the changed color parameter.

12. The method according to claim 11, further comprising:

based on the comparing being identified that the output brightness value is higher than the reference output brightness value, changing the color parameter to decrease a wavelength value of a color, the wavelength value being included in the first section, among colors included in the content output through the display, and changing the color parameter to increase a wavelength value of a color, the wavelength value being included in the second section, among the colors included in the content.

13. The method according to claim 11, further comprising:

based on the comparing being identified that the output brightness value is lower than the reference output brightness value, changing the color parameter to increase a wavelength value of a color, the wavelength value being included in the first section, among colors included in the content output through the display, and changing the color parameter to decrease a wavelength value of a color, which the wavelength value being included in the second section, among the colors included in the content.

14. The method according to claim 11, wherein the electronic apparatus further comprises a backlight unit, and wherein the method further comprises obtaining the output brightness value by identifying current applied to the backlight unit and a section where the backlight unit is driven.

15. The method according to claim 11, wherein the color parameter comprises at least one of a red (R) value, a green (G) value or a blue (B) value of a color included in the content.

16. The method according to claim 11, further comprising outputting a notice for informing that the content is output with the color parameter changed based on change in the output brightness value.

17. The method according to claim 11, wherein the electronic apparatus further comprises a communicator configured to establish communication with a different electronic apparatus, and wherein the method further comprises controlling the communicator to transmit a notice, which informs that the content is output with the color parameter changed based on change in the output brightness value, to the different electronic apparatus.

18. The method according to claim 11, further comprising obtaining accumulated data about change in the output brightness value, and changing the reference output brightness value based on the accumulated data.

19. The method according to claim 11, further comprising changing the color parameter based on an increased difference between the output brightness value and the reference output brightness value.

20. A computer program product comprising a non-transitory computer-readable recording medium having instructions stored thereon that, when executed, instruct a computer to:

obtain an output brightness value of a display;

compare the obtained output brightness value and a reference output brightness value of the display;

identify a wavelength value of a color included in a content output through the display;

identify a section to which the identified wavelength value belongs among a first section and a second section, the first section corresponding to a wavelength range in which the wavelength value is lower than a predetermined value and the second section corresponding to a wavelength range in which the wavelength value is above the predetermined value;

based on the comparing, change a color parameter to increase or decrease the wavelength value of the color corresponding to the section to which the identified wavelength value belongs; and output content through the display based on the changed color parameter.

* * * * *